US010958010B2

(12) United States Patent
Lindkamp et al.

(10) Patent No.: US 10,958,010 B2
(45) Date of Patent: Mar. 23, 2021

(54) HOLDING FRAME FOR A PLUG CONNECTOR OR A MOUNTING FLANGE FOR HOLDING A CIRCUIT BOARD

(71) Applicant: HARTING Electronics GmbH, Espelkamp (DE)

(72) Inventors: Marc Lindkamp, Lübbecke (DE); Gert Havermann, Wallenhorst (DE)

(73) Assignee: HARTING ELECTRONICS GMBH

( * ) Notice: Subject to any disclaimer, the term of this patent is extended or adjusted under 35 U.S.C. 154(b) by 0 days.

(21) Appl. No.: 16/490,873

(22) PCT Filed: Apr. 18, 2018

(86) PCT No.: PCT/DE2018/100368

§ 371 (c)(1),
(2) Date: Sep. 3, 2019

(87) PCT Pub. No.: WO2018/210373

PCT Pub. Date: Nov. 22, 2018

(65) Prior Publication Data

US 2020/0076114 A1 Mar. 5, 2020

(30) Foreign Application Priority Data

May 16, 2017 (DE) ..... 10 2017 110 662.7

(51) Int. Cl.

| | |
|---|---|
| ***H01R 13/518*** | (2006.01) |
| ***H01R 12/72*** | (2011.01) |
| ***H01R 13/502*** | (2006.01) |
| ***H01R 13/66*** | (2006.01) |
| *H01R 13/621* | (2006.01) |

(Continued)

(52) U.S. Cl.
CPC ..... *H01R 13/518* (2013.01); *H01R 12/722* (2013.01); *H01R 13/502* (2013.01);
(Continued)

(58) Field of Classification Search
CPC ..... H01R 13/6215; H01R 12/7005; H01R 13/631; H01R 13/629; H01R 13/64;
(Continued)

(56) References Cited

U.S. PATENT DOCUMENTS 5,211,571 A * 5/1993 Arai ..... H01R 12/7005 439/325
6,004,162 A 12/1999 Harting et al. ..... 439/701
(Continued)

FOREIGN PATENT DOCUMENTS

BE 600984 9/1961
BE 600984 A * 9/1961
(Continued)

OTHER PUBLICATIONS

International Preliminary Report on Patentability issued in application No. PCT/DE2018/100368, dated Nov. 28, 2019 (9 pgs).
(Continued)

*Primary Examiner* — Abdullah A Riyami
*Assistant Examiner* — Justin M Kratt
(74) *Attorney, Agent, or Firm* — Hayes Soloway P.C.

(57) ABSTRACT

Disclosed is a holding frame for accommodating a circuit board, wherein the holding frame has a substantially rectangular basic shape and has two holding arms sticking out perpendicularly from the frame plane, each holding arm having a groove in which the circuit board can be held. A circuit board can thus be integrated in a heavy-duty plug connector in a mechanically stable yet low-wear manner.

7 Claims, 3 Drawing Sheets

(51) Int. Cl.

| | |
|---|---|
| *H01R 13/631* | (2006.01) |
| *H01R 13/629* | (2006.01) |
| *H01R 13/514* | (2006.01) |
| *H01R 13/64* | (2006.01) |
| *H01R 13/46* | (2006.01) |
| *H01R 12/70* | (2011.01) |

(52) U.S. Cl.
CPC ..... *H01R 13/6658* (2013.01); *H01R 12/7005* (2013.01); *H01R 12/7052* (2013.01); *H01R 12/721* (2013.01); *H01R 12/724* (2013.01); *H01R 13/46* (2013.01); *H01R 13/514* (2013.01); *H01R 13/621* (2013.01); *H01R 13/629* (2013.01); *H01R 13/6215* (2013.01); *H01R 13/631* (2013.01); *H01R 13/64* (2013.01)

(58) Field of Classification Search
CPC ..... H01R 13/514; H01R 13/518; H01R 12/7052; H01R 12/721; H01R 12/724; H01R 13/46; H01R 13/502; H01R 12/722; H01R 13/6658; H01R 13/621
USPC ..... 439/362, 378, 361
See application file for complete search history.

(56) References Cited

U.S. PATENT DOCUMENTS

| | | | | |
|---|---|---|---|---|
| 6,435,897 | B1 * | 8/2002 | Paul | H01R 12/7005 439/374 |
| 7,316,591 | B2 | 1/2008 | Ferderer | 439/701 |
| 8,147,254 | B2 | 4/2012 | Shuey et al. | 439/74 |
| 9,166,341 | B2 | 10/2015 | Wang et al. | H01R 13/6456 |
| 9,923,307 | B2 | 3/2018 | Beischer et al. | H01R 13/639 |
| 2011/0122617 | A1 | 5/2011 | Frey et al. | F21V 7/00 |
| 2012/0196473 | A1 | 8/2012 | Foung | 439/404 |

FOREIGN PATENT DOCUMENTS

| | | | |
|---|---|---|---|
| CN | 1988277 | 6/2007 | H01R 13/518 |
| CN | 201570677 | 9/2010 | H01R 13/512 |
| CN | 101855788 | 10/2010 | H01R 13/28 |
| CN | 102099620 | 6/2011 | F21V 17/10 |
| CN | 103563186 | 2/2014 | H01R 13/64 |
| CN | 105027361 | 11/2015 | H01R 13/518 |
| DE | 19707120 | 6/1998 | H01R 13/514 |
| EP | 0555733 | 8/1993 | H01R 31/06 |
| EP | 1801927 | 6/2007 | H01R 13/518 |

OTHER PUBLICATIONS

International Search Report (w/translation) and Written Opinion (w/machine translation issued in application No. PCT/DE2018/100368, dated Jun. 15, 2018 (14 pgs).

Chinese Official Action issued in related Chinese Patent Application Serial No. 201880032399.8, dated Jul. 3, 2020 with machine translation (13 pages).

* cited by examiner

HOLDING FRAME FOR A PLUG CONNECTOR OR A MOUNTING FLANGE FOR HOLDING A CIRCUIT BOARD

BACKGROUND OF THE INVENTION

The invention is based on a holding frame for a plug connector or a mounting flange.

Holding frames of this sort are employed in particular with heavy plug connectors. So-called converter electronics can be soldered to the circuit board. Light signals originating in glass fibers are, for example, converted into electrical signals here. A sensor system that monitors the operating state of the connected machine and/or of the plug connector can, however, also be mounted on the circuit board.

BRIEF DESCRIPTION OF THE PRIOR ART

A holding frame for holding plug connector modules is known from DE 197 071 120 C1, consisting of two halves joined in a hinged manner, whereby the plug connector modules that can be inserted into recesses in the holding frame are held with positive lock when the halves are folded together.

EP 1 801 927 B1 shows a holding frame consisting of a plastic material for accepting a plurality of plug connector modules to be arranged next to one another. A plurality of wall segments separated by slots are provided for the holding frame of the plug connector modules on its plug side, of which each two symmetrically opposing wall segments form an insertion region for a plug connector module.

In order to supplement the plug connector modules associated with this kind of holding frame with appropriate electronics, a circuit board must be integrated into the plug connector modules, and this can lead to space problems. Alternatively, the circuit board must be fastened in the plug connector housing in another way which, depending on the type of fastening and the application field, can lead to mechanical problems such as, for example, vibration damage to the circuit board.

SUMMARY OF THE INVENTION

The object of the invention is that of proposing a holding frame in which a circuit board can be held in a space-saving and secure manner.

The holding frame according to the invention comprises a recess for a circuit board. The holding frame has an essentially rectangular basic shape. The basic shape consists of a rectangular frame piece which encloses a frame plane. Two holding arms protruding from the frame plane are formed at the frame piece. A groove facing towards the inside is formed in the holding arms. The respective grooves of the holding arms face towards one another and are aligned parallel to one another. A circuit board can be inserted into the grooves and thereby held in the holding frame.

The holding frame advantageously consists of a plastic material. The holding frame can thereby be manufactured economically in an injection molding process.

Alternatively, the holding frame can also be manufactured in a die-casting method, for example a zinc die-casting method or an aluminum die-casting method from a zinc or aluminum alloy. It is then particularly stable and temperature-resistant.

In a particularly advantageous variant of the invention, the holding frame is made in one piece. The holding frame can thereby be produced in large numbers and particularly economically.

Advantageously the holding frame comprises two guide arms protruding perpendicularly from the frame plane. The holding frame is aligned accurately to a mating plug connector or a mounting flange by means of the guide arms. The insertion force and the wear of the contact elements during insertion are thereby reduced.

Advantageously the holding frame comprises two openings into each of which one guide arm of the holding frame of a mating plug connector or of a mounting flange can be inserted. When a plug connector and a mating plug connector are pushed together, the guide arms of each holding frame engage in the openings of the respective other opposing holding frame. The guide arms and the associated openings together act as means of guidance of the holding frame.

BRIEF DESCRIPTION OF THE DRAWINGS

An exemplary embodiment of the invention is shown in the drawings and is explained in more detail below. Here.

The figures contain illustrations that are in part simplified or schematic. In some cases identical reference signs have been used for elements that are equivalent but not in all cases identical. Different views of the same elements may be scaled differently.

DETAILED DESCRIPTION OF THE DRAWINGS

Figure 1:
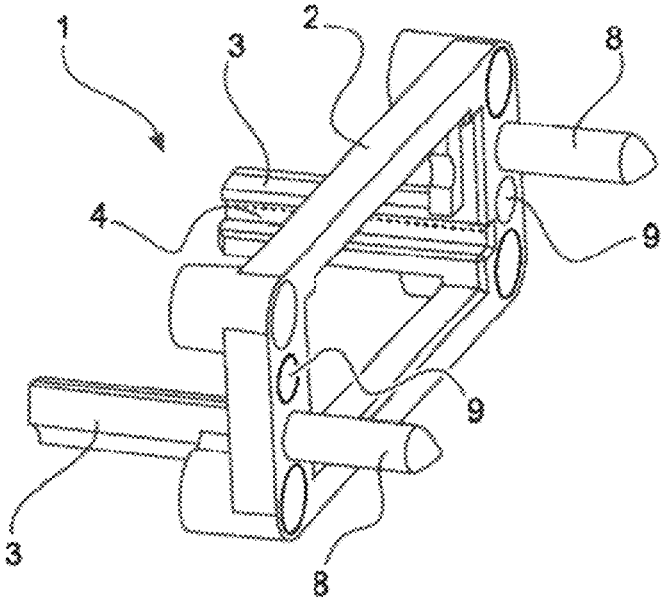
FIG. 1 shows a perspective illustration of a holding frame according to the invention.

FIG. 1 shows a perspective illustration of a holding frame 1 according to the invention. The holding frame 1 comprises an essentially rectangular base body 2. Two holding arms 3 protruding from the frame plane are formed at the base body 2. The holding arms 3 are located at the narrow sides of the base body 2, and are aligned parallel to one another. The holding arms 3 are located on the so-called connection side of the holding frame 1. A groove 4 is formed in each of the holding arms 3. A circuit board 5 can be inserted into the grooves 4 of the holding arms 3. In this way the circuit board 5 is held in the holding frame 1 in a vibration-proof manner and is, in particular, fixed to it.

Figure 2:
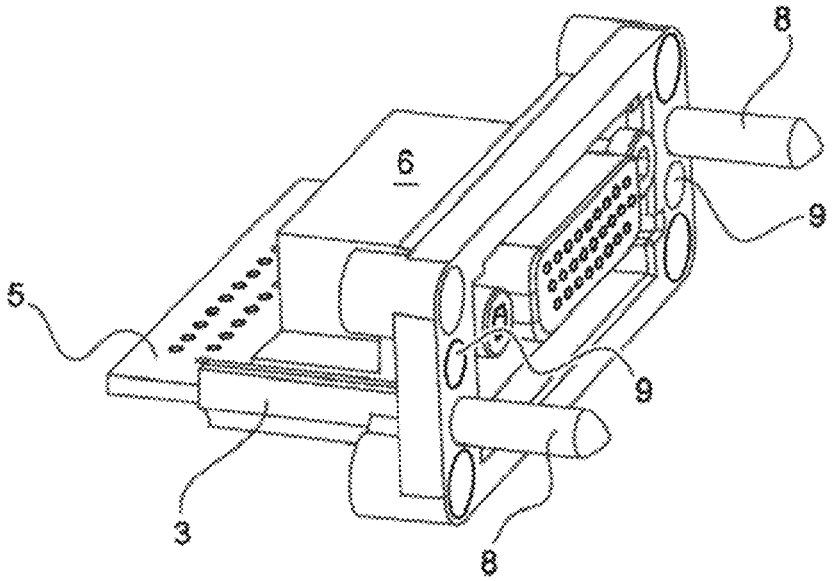
FIG. 2 shows a perspective illustration of the holding frame according to the invention in which a circuit board is held and with which a plug connector is connected.

It can be seen in FIG. 2 that a plug connector 6 is soldered to the circuit board 5. The plug face 7 of the plug connector 6 protrudes on the plug side out of the base body 2 of the holding frame 1. A guide arm 8 protruding from the frame plane is formed on the plug side of each of the narrow sides of the base body 2. The guide arms 8 serve to provide accurate alignment of the holding frame 1 with a further holding frame 1' in a mating plug connector or a mounting flange. The guide arms 8 are arranged with a mutual offset in their height. Due to the offset arrangement of the guide arms 8, the holding frame 1 can be plugged together with a holding frame 1' of identical construction. The holding frames here can be installed in a plug connector housing 10 or in a mounting flange 10'. Openings 9 are formed in the holding frame 1 above or below the guide arms 8. The guide arms 8 of another holding frame 1' can engage here in the plugging process. This process is explained more precisely further below.

Figure 3:
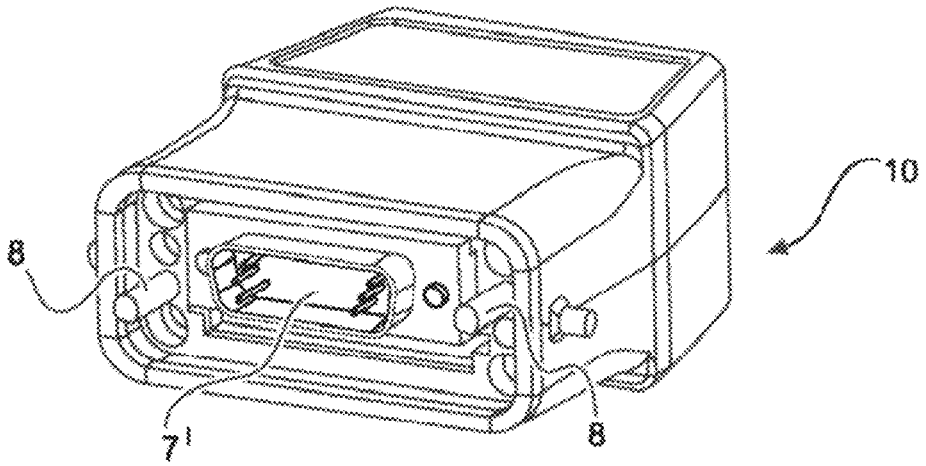
FIG. 3 shows a perspective illustration of a heavy plug connector with the integrated holding frame and the circuit board fixed to it and the plug connector connected to it.
Figure 4:
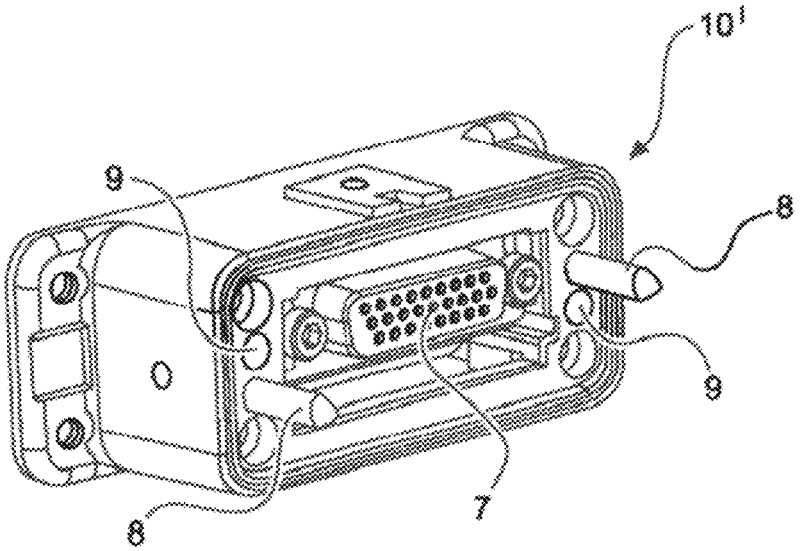
FIG. 4 shows a perspective illustration of a mounting flange with the integrated holding frame and the circuit board fixed to it and the plug connector connected to it.

A plug connector 10 is shown in FIG. 3 and a corresponding mounting flange 10' in FIG. 4. A holding frame 1 according to the invention with a circuit board 5 and a plug connector 6 having a plug face 7' mounted thereon is contained in both the plug connector housing 10 and in the mounting flange 10'.

The holding frame 1 can be inserted or mounted, together with the circuit board 5, both from the front—i.e. the plug side or also from the rear—i.e. the connection side into a plug connector housing 10 or a mounting flange 10'.

Figure 5B:
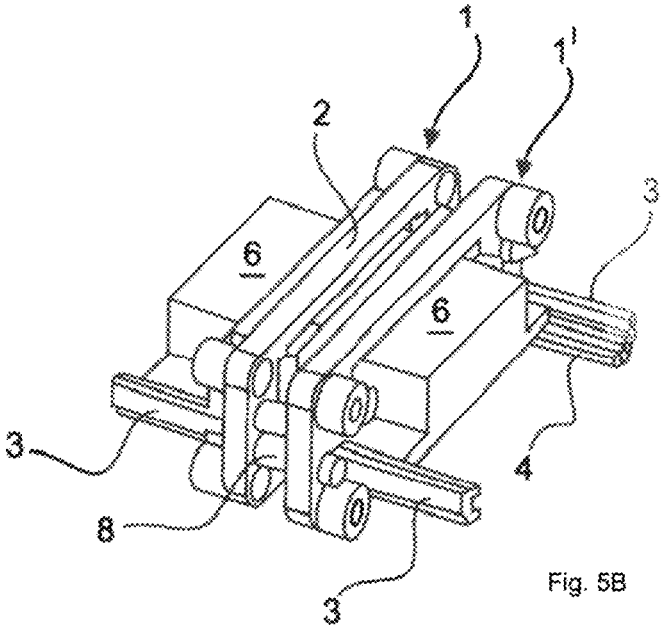
FIGS. 5A and 5B show sketches showing the principle of a process in which two holding frames are aligned and plugged together.
Figure 5A:
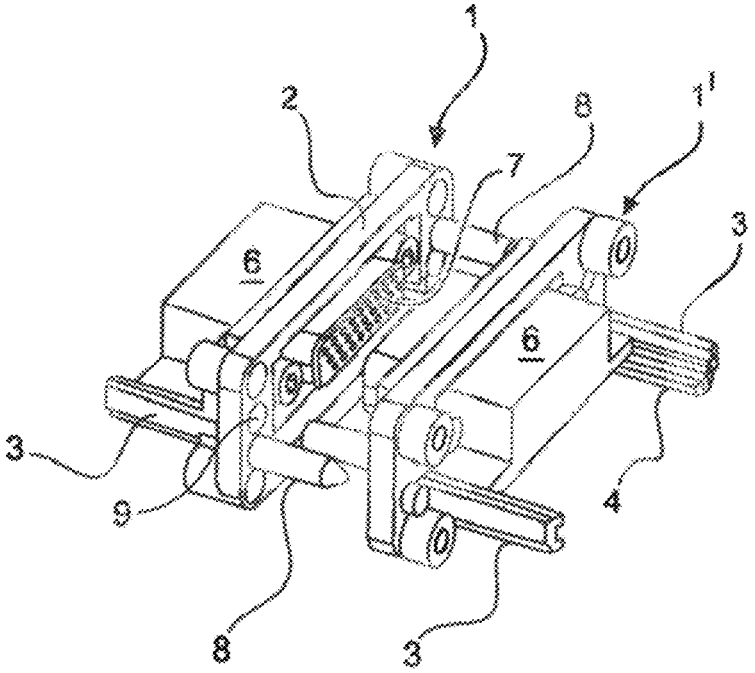

The process in which a pair of holding frames 1, 1' are plugged together is shown in FIGS. 5A and 5B. During the plugging process, the guide arms 8 of the one holding frame 1 engage in the openings 9 of the opposing holding frame 1' and vice versa. As a result, the holding frames 1, 1' are accurately positioned with respect to one another. The guide arms 8 and the associated openings 9 together act as means of guidance during the plugging process. As a result, the plug connectors 6 located on the circuit board 5 can be plugged together with low wear. The guide arms 8 and openings 9 here act at the same time as so-called encoding means. It is not possible for the plug connector housing 10 and mounting flange to be plugged in in a twisted manner.

Even though various aspects or features of the invention are respectively shown in combination in the figures, it is clear to the expert except when otherwise stated that the combinations illustrated and discussed are not the only possibilities. In particular, units corresponding to one another, or complexes of features from different exemplary embodiments, can be exchanged for one another.

LIST OF REFERENCE SIGNS

1 Holding frame
2 Base body
3 Holding arm
4 Groove
5 Circuit board
6 Plug connector
7 Plug face
8 Guide arm
9 Opening
10 Plug connector housing
10' Mounting flange

The invention claimed is:

1. A holding frame for holding a circuit board, wherein the holding frame comprises an essentially rectangular base body, wherein the holding frame comprises two holding arms formed on the narrow sides of the rectangular base body and protruding perpendicularly from the frame plane, wherein the holding arms each comprise a groove, wherein a circuit board can be inserted between the holding arms and can be held by the grooves, and wherein the holding frame comprises two guide arms formed at the narrow sides of the rectangular base body arranged with a mutual offset in their height and protruding perpendicularly from the frame plane for the accurate alignment of a plug connector with a mounting flange on the plug connector.

2. The holding frame as claimed in claim 1, wherein the holding frame is formed of a plastic material.

3. The holding frame as claimed in claim 1, wherein the holding frame is made in one piece.

4. The holding frame as claimed in claim 1, wherein the holding frame comprises two openings into each of which one of the guide arms of the holding frame is inserted for the accurate alignment of the plug connector with the mounting flange.

5. The holding frame as claimed in claim 1, wherein the guide arms protrude from the base body of the holding frame in opposite directions.

6. A heavy plug connector with a holding frame as claimed in claim 1, further comprising a circuit board and a plug connector mounted on the circuit board.

7. The holding frame as claimed in claim 2, wherein the holding frame is made in one piece.

* * * * *